US005884363A

United States Patent [19]

Tofts

[11] Patent Number: 5,884,363

[45] Date of Patent: Mar. 23, 1999

[54] HINGE

[75] Inventor: David John Tofts, Narangba, Australia

[73] Assignee: Kalford Pty Ltd., Queensland, Australia

[21] Appl. No.: 842,246

[22] Filed: Apr. 23, 1997

[51] Int. Cl.[6] ..... E05D 11/02; E05D 5/02

[52] U.S. Cl. ..... 16/223; 16/104; 16/274; 16/386; 16/387; 16/97; 29/11; 160/201

[58] Field of Search ..... 16/97, 221, 223, 16/355, 386, 249, 274; 29/11; 160/201, 206, 207, 209, 210, 213

[56] References Cited

U.S. PATENT DOCUMENTS

| | | | |
|---|---|---|---|
| 377,104 | 1/1888 | Hart et al. | 29/11 |
| 1,936,237 | 11/1933 | Johnson | 16/104 |
| 2,233,351 | 2/1941 | Rowe | 16/104 |
| 2,525,309 | 10/1950 | Norberg | 16/97 |
| 3,008,175 | 11/1961 | Biedinger et al. | 16/97 |
| 3,102,583 | 9/1963 | Rowe et al. | 16/104 |
| 3,181,197 | 5/1965 | Sperber | 16/274 |
| 4,485,544 | 12/1984 | Van Ryswyk | 16/386 |
| 5,188,163 | 2/1993 | Schwartzengraber et al. | 160/201 |
| 5,235,724 | 8/1993 | Perrin et al. | 160/201 |

*Primary Examiner*—Chuck Y. Mah
*Assistant Examiner*—Donald M. Gurley
*Attorney, Agent, or Firm*—Renner, Otto, Boisselle & Sklar, P.L.L.

[57] ABSTRACT

A hinge for a sectional overhead door. The hinge having first and second hinge parts. The second part has side flanges and a connecting base. The first part has a body and an integral sleeve of a length greater than the distance between extremities of the flanges. The side flanges have opposed apertures. The sleeve is received by the apertures as the side flanges are configured to extend substantially at right angles to the base.

17 Claims, 6 Drawing Sheets

HINGE

FIELD OF THE INVENTION AND RELATED ART STATEMENT

THIS INVENTION relates to a hinge for sectional overhead doors.

Sectional overhead doors are typically employed for garages and are arranged to span across a doorway and overlap slightly inner walls of the garage adjacent the doorway. Vertical edges of each of the panels have a stile secured to them and a hinge comprising hinge members is mounted to the stiles to interconnect the panels and to allow adjacent panels to pivot relative to each other to facilitate opening and closing of the door.

Two tracks are present on opposite sides of the doorway. Each track has a first part extending along a substantially vertical path adjacent an inner edge of the doorway and a second part extending from above the doorway and substantially horizontally into the garage. The hinges adjacent vertical outer edges of the door have a shaft or pin which rotatably carries a guide roller at one end. The roller is arranged to travel in the track to guide the panels of the door during opening and closing of the door.

The first part of each track, as mentioned, is positioned at a substantially vertical orientation such that an upper end of the first part of the track is more spaced into the garage than the lower end. Typically the upper end is about 25 mm further from the periphery of the doorway than the lower end. In this way as the door is opened, the panels, as they travel upwardly also slightly separate from the inner walls of the garage adjacent the doorway. This ensures that the outer faces of the panels, which are usually powder coated or otherwise finished are not damaged by contacting the inner wall of the garage as the panel moves during opening or closing of the door.

Each outer hinge consists of two hinge members and a pin or shaft with a guide roller. Since the first part of the track departs slightly from a vertical orientation and it is desired that when the door is closed that it seals neatly against the inner wall of the doorway, no two hinges along one edge of the door are the same in configuration.

Typically, such a sectional overhead door has a plurality of panels and often at least four panels and the first hinge extends between the lowermost panel and an adjacent panel and the guide roller shaft has its axis coincident with the pivot axis of the hinge. The hinges used to connect other panels are constructed such that the axis of the pivot pin or shaft is progressively further spaced from the panels.

Currently, a number of different hinge member constructions are employed. The lowermost hinge according to one known construction has two hinge members both of which are substantially U shaped having upstanding side flanges and interconnecting main bases. Opposed apertures are formed in the side of flanges and a sleeve is positioned to extend between the side flanges and through the apertures to hold the hinge members together for pivotal movement relative to one another. The pivot pin carries the guide roller. Thus, this lower hinge consists of three separate components excluding the pivot pin.

Another current construction for a lower hinge has a first hinge member with a planar body having an integral formed sleeve at one end and a second hinge member with spaced side flanges and a connecting base. Opposed apertures are present in the flanges and when the sleeve is located between the flanges a separate rolled sleeve of smaller diameter than the sleeve of the first hinge member is arranged to extend through that sleeve and has its ends deformed to lock the three components together. A pivot pin with a guide roller is rotatably received within the smaller sleeve.

The construction of hinges other than the lowermost hinge typically includes two U shaped hinge members with one of the members having a pair of opposed apertures in the side flanges and the other hinge member having two pairs of opposed apertures formed in the side flanges. Two separate rolled sleeves are arranged to extend between the flanges with one sleeve providing the pivot connection between the two hinge members and the other providing a sleeve for receiving the pin shaft which carries the guide roller. Such a construction consists of four components excluding the pin which carries the roller. The separate rolled sleeves are typically of the same length but may be of a different diameter.

Another hinge construction for hinges other than the lowermost hinge includes a first hinge member having a planar body with an integrally formed sleeve extending across one end and a second U shaped hinge member having two pairs of opposed apertures in side flanges thereof. A first sleeve extends through a first pair of the apertures and is deformed at its ends to lock it in place. That sleeve has a large diameter and rotatably receives a pin which carries a guide roller. A second sleeve of smaller diameter passes through the integral sleeve of the first hinge member and through the second pair of apertures to secure the first hinge member to the second. This construction has four distinct parts excluding the pin with the guide roller.

All of these constructions have a large number of parts and because of this are relatively complex in construction and assembly and expensive to make.

OBJECT AND SUMMARY OF THE INVENTION

It is an object of the present invention to provide a hinge which at least minimises the disadvantages referred to above.

According to one aspect the invention provides a hinge for interconnecting two adjacent panels of a sectional overhead door, the hinge including a first hinge part and a second hinge part, the first hinge part having a body with a sleeve extending across the body, the second hinge part being substantially U shaped and having two opposed side flanges and an interconnecting base extending between the flanges, a pair of opposed apertures in the flanges adapted to receive the sleeve whereby the two hinge parts may pivot relative to one another.

Where the hinge is intended to form a lowermost hinge interconnecting the lowermost and an adjacent panel, the sleeve rotatably receives a pivot pin or shaft having a guide roller at one end thereof. The guide roller is adapted to locate in a guide track for guiding the door in its movement between an open and a closed position.

It is preferred that the flanges be provided with short bosses surrounding the apertures to provide a greater bearing surface for ends of the sleeve when received in the apertures. The bosses may be either inwardly or outwardly directed.

The hinge parts are provided with mounted apertures or recesses to facilitate the attachment of the hinge parts to stiles to which the door panels are secured. The apertures are preferably provided in the bodies of each of the hinge parts. Preferably each body has a plurality of such apertures. In one form, each body has a first series of relatively short slotted apertures at spaced locations across the body and adjacent an axis extending through the sleeve. The series may comprise two or three apertures. Preferably the body of the first hinge part has a second series of transversely spaced apertures spaced from the first series.

Each of the bodies preferably has an elongate fixing aperture extending along it.

Preferably, each of the hinge parts is provided with one or more strengthening deformations. The deformations may comprise ribs pressed from or into each of the parts. Preferably the first part has strengthening ribs formed in the body and in the sleeve. It is preferred that the sleeve have two spaced ribs extending substantially circumferentially and these ribs assist in the retention of any lubricant introduced into the sleeve to lubricate the pivot pin or shaft in its rotation relative to the sleeve. An aperture may extend through the sleeve to enable lubricant to be introduced. Preferably the sleeve has a length at least as long as the outermost extremities of the bosses. More preferably the sleeve has a length substantially the same as the width of the body.

Where the hinge is intended to interconnect panels other than the lowermost and the next adjacent panel it is preferred that the second hinge part have two opposed pairs of apertures formed in the side flanges. One of the pairs of apertures receives the sleeve of the first hinge part. With such a hinge it is preferred that the second hinge part be provided with a sleeve extending across it and having a length substantially the same as the width of the hinge part and the distance between the outer extremities of the side flanges. This sleeve is adapted to be received by the apertures of the second pair of opposed apertures and functions to rotatably receive the pivot pin or shaft to which the guide roller is mounted.

The sleeve of the second hinge part may be formed as a continuation of the connecting base. Preferably an inner end of the connecting base is directed outwardly and formed into a sleeve. The outwardly directed portion has a length corresponding to the desired spacing of the guide roller shaft from the door panels to compensate for the slight deviation from the vertical at which the first part of the track extends. Thus, the second pair of apertures are correspondingly spaced from the connecting base.

The method of assembling the hinge of the invention involves forming the first hinge part with the sleeve, forming the second hinge part but initially having the side flanges extending in the same plane as the interconnecting base and then bending the side flanges out of the plane of the connecting base and to cause the flanges to extend substantially at right angles thereto and ensuring that the ends of the sleeve on the first part are caused to pass through the opposed apertures in the side flanges of the second part to pivotally couple the parts to each other.

When assembling a hinge other than one intended as a lowermost hinge on a door additional steps are performed. A portion of the interconnecting base of the second part is also configured to extend out of the plane and has an end formed into a sleeve. The flanges of the second hinge part are provided with two pairs of opposed apertures such that when the flanges are configured from a position planar with the base to a position substantially at right angles to the base both sleeves pass through respective pairs of the apertures.

BRIEF DESCRIPTION OF THE DRAWINGS

Particular preferred embodiments of the invention will be described with reference to the drawings in which.

DETAILED DESCRIPTION OF PREFERRED EMBODIMENTS

Figure 1:
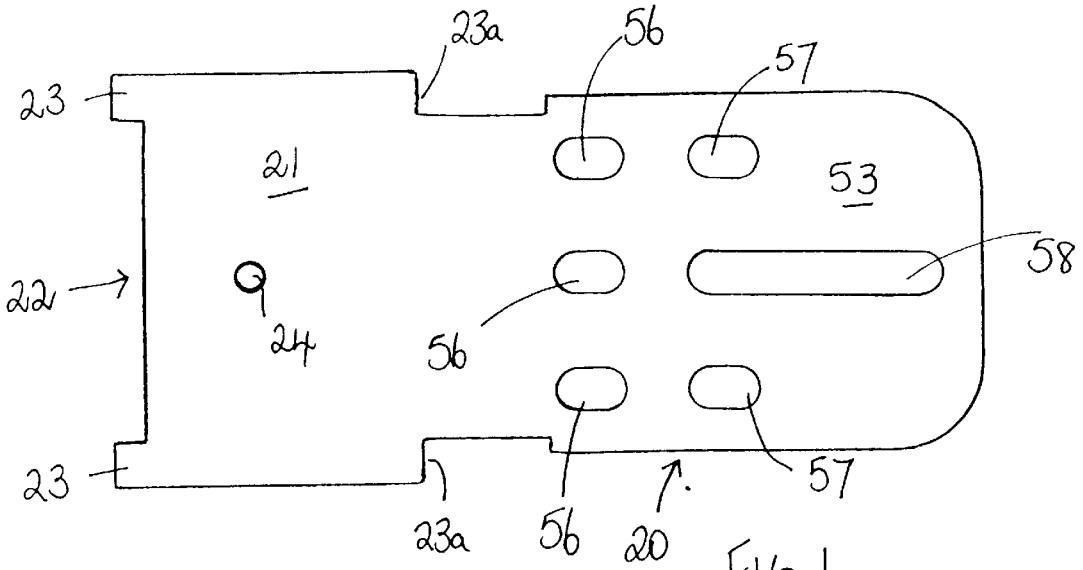
FIG. 1 is a view of a blank from which a first hinge part of the invention may be made.

The blank 20 in FIG. 1 has a slot 58, a first series of apertures 56 and a second series of apertures 57 formed in a body 53. Forward portion 21 has a stepped edge 22 with two tabs 23. The portion 21 has shoulders 23*a*. When the portion 21 is formed into a sleeve, tabs 23 touch or abut the shoulders 23*a* with slight clearance and thus assisting in the migration of lubricant to lubricate the parts of the hinge when they pivot relative to each other. Aperture 24 extends through the forward part. Blank 20 is used to form a first hinge part like that shown in FIG. 5*a*.

Figure 2:
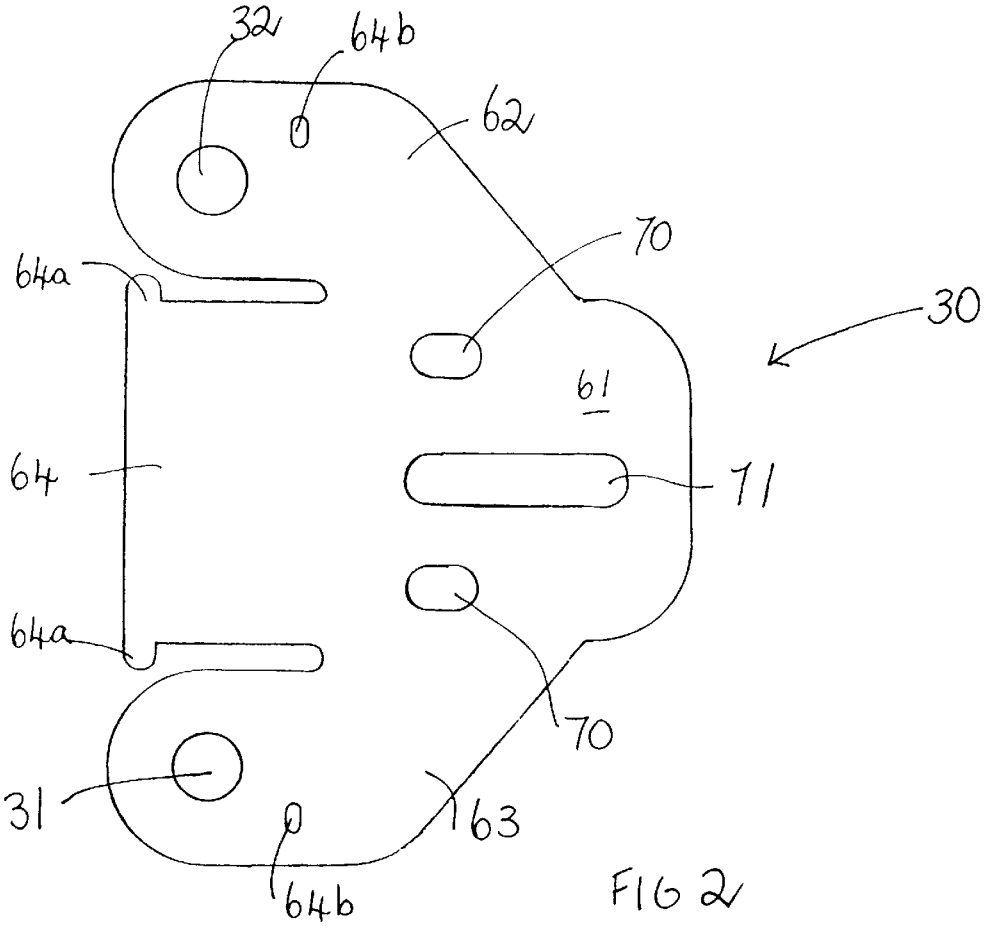
FIG. 2 is a view of a blank from which a second hinge part of the invention for a lowermost hinge is made.

FIG. 2 shows a blank 30 from which a second hinge part of the hinge may be made. The blank 30 has a base 61 with mounting apertures 70 and slot 71. The blank has an extension 64 and two side flanges 62, 63. Flanges 62, 63 have apertures 31, 32. Extension 64 has opposed lobes or tabs 64*a* and the side flanges 62 and 63 are provided with apertures 64*b*.

Figure 3:
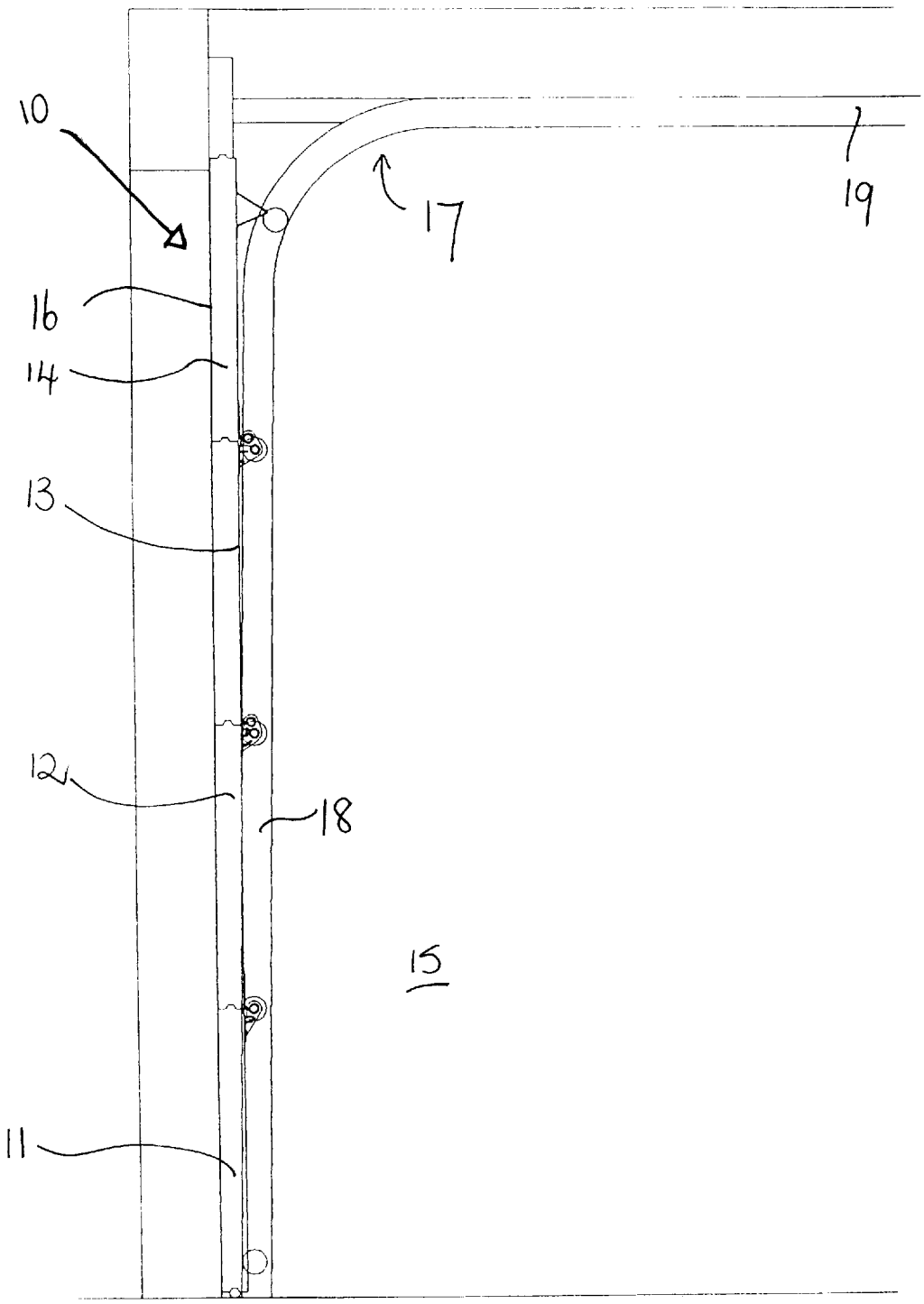
FIG. 3 is a diagrammatic sectional view of an overhead door.

FIG. 3 shows a door 10 consisting of four panels 11, 12, 13, and 14 with the lowermost panel being panel 11. The panels extend over a doorway into a garage 15. The door 10 is located against and slightly overlapping an edge 16 of the doorway. The panels each have short stiles secured adjacent opposed vertical edges as well as at locations between the opposed edges and hinges are mounted to these stiles. The hinges carry a guide shaft having a guide roller adapted to travel along track 17 as the door is moved between its open and closed positions. The track 17 is located adjacent sides of the door and has a first track part 18 which departs from a vertical orientation as shown and a second track part 19 extending above an upper part of the doorway. When the door is shut it abuts an inner periphery of the doorway but because the track part 18 is inclined, the door moves away from the inner periphery as the door is opened. Because of this, the pivot pins or shafts for the guide roller are progressively further spaced from the panels with those lowermost on the door being the closest.

Figure 4:
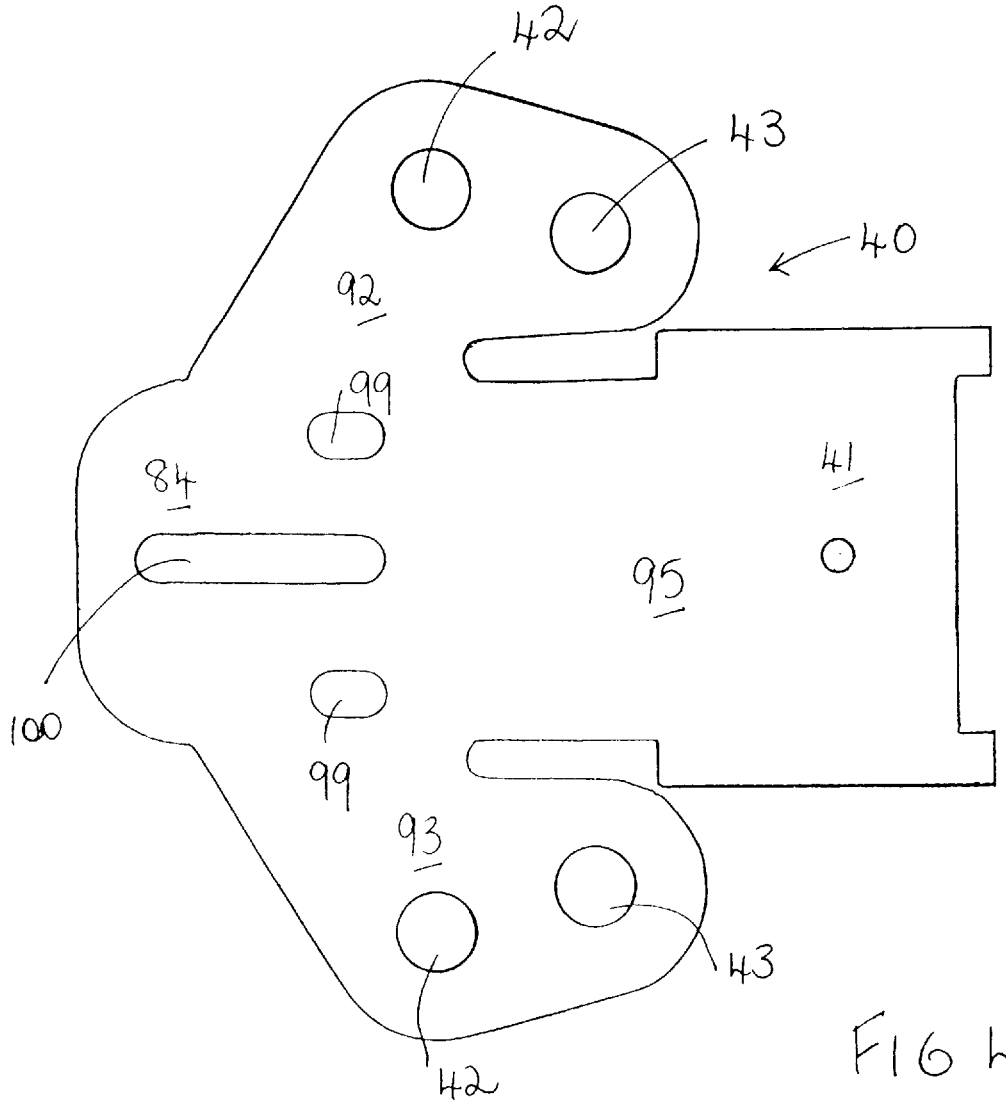
FIG. 4 is a view of a blank from which a typical second hinge part for a hinge other than the lowermost hinge may be made.

FIG. 4 shows a blank 40 from which a second hinge part for a typical hinge other than a lowermost hinge. The blank has a base 84 and two side flanges 92, 93. Forward portion 41 depends from extension 95. Slot 100 extends along base 84 and apertures 99 are located either side of the slot 100. Each of the flanges 92, 93 has apertures 42, 43 formed in them.

Figure 5A:
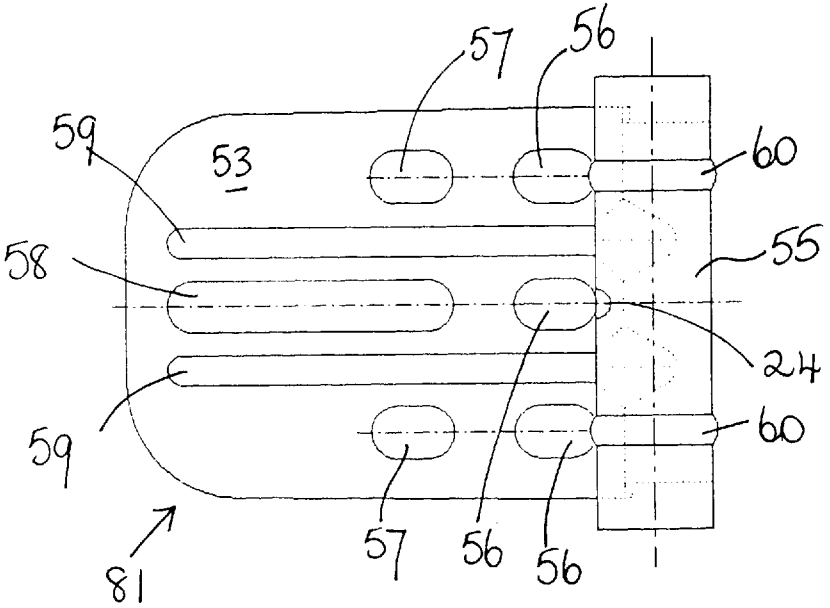
FIGS. 5*a* and 5*b* are plan and elevational views of a hinge part made from the blank of FIG. 1.
Figure 5B:
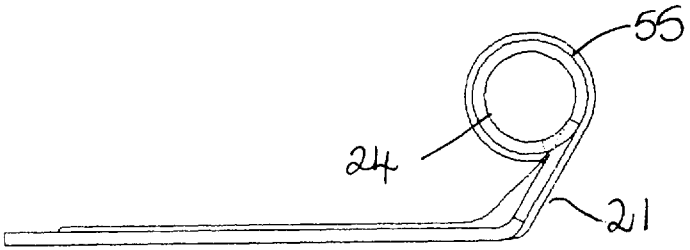

FIG. 5*a* shows a first part 81 of a hinge. First part 81 is formed from the blank 20 of FIG. 1 and has a sleeve 55 formed from forward portion 21 shown in FIG. 1. The first hinge part 81 shown in plan view is shown in side elevation in FIG. 5*b*. Strengthening ribs 59 extend along the body 53 of the first part 81 and ribs 60 extend around the sleeve. The lubricating aperture is indicated by the numeral 24.

Figure 6A:
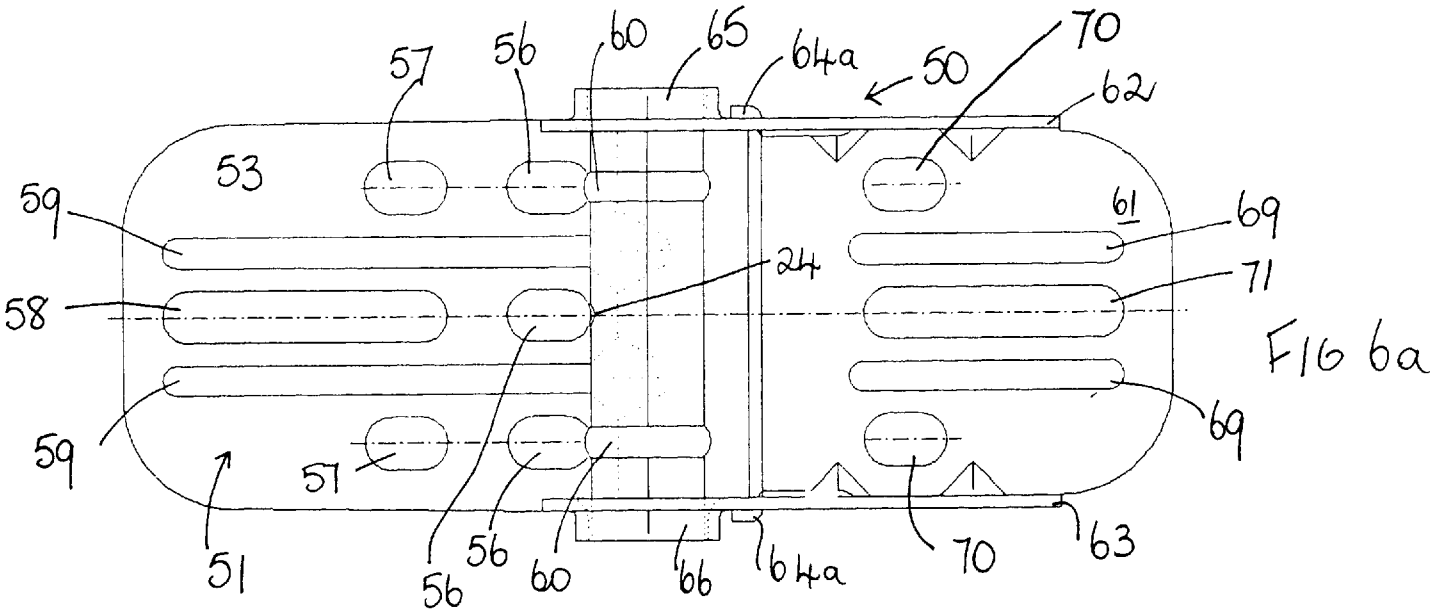
FIGS. 6*a* and 6*b* are plan and side views of an assembled hinge adapted to be used to interconnect a lowermost and adjacent panel of the door.
Figure 6B:
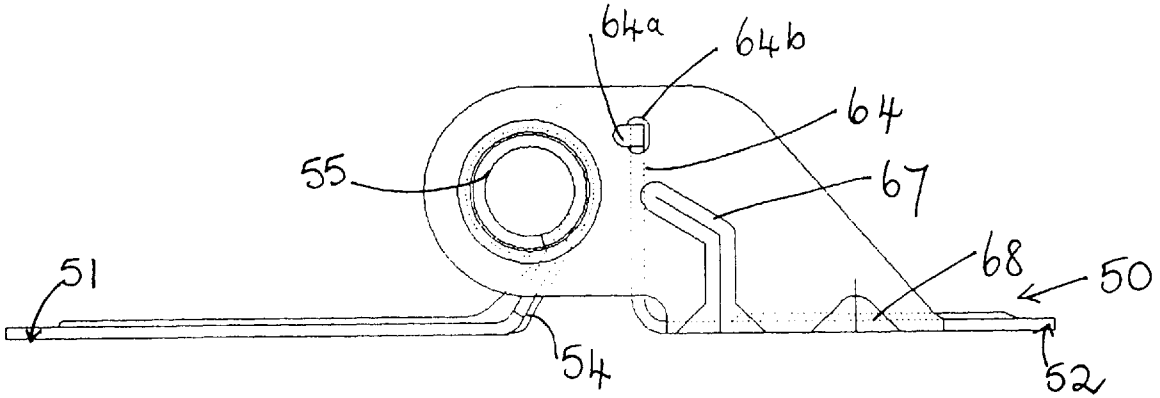

FIGS. 6*a* and 6*b* show a hinge 50 having a first hinge part 51 and a second hinge part 52. The part 51 has a body 53 and an outwardly extending end 54 having a distal end formed into a sleeve 55. Sleeve 55 has a length greater than the width of body 53. Part 51 has a first series 56 and a second series 57 of mounting apertures and an elongate mounting slot 58. Strengthening ribs 59 extend along body 53 while strengthening ribs 60 extend around the sleeve 55. The interior of the ribs 60 act as small wells for lubricant to assist the rotation of a guide roller shaft (not shown) received within the sleeve 55.

The second part 52 has a base 61 and two opposed side flanges 62, 63. An inner end portion 64 is directed away from the base 61 and is received between the flanges 62 and 63. The flanges have short apertured laterally outwardly directed bosses 65, 66 through which the sleeve 55 extends. The flanges have strengthening deformations 67, 68 while base 61 has strengthening ribs 69. Mounting apertures 70 and mounting slot 71 facilitate the mounting of the part 52 to a stile (not shown). The sleeve 55 and the apertured bosses 65, 66 allow the hinge parts to be pivotally coupled to one another. When the hinge parts are made up, tabs 64*a* project through apertures 64*b* and these tabs are then bent over against an outside face of the side flanges 62 and 63 to ensure that the flanges are securely held against movement which tends to fold the flanges 62 and 63 away from one another.

Figure 7A:
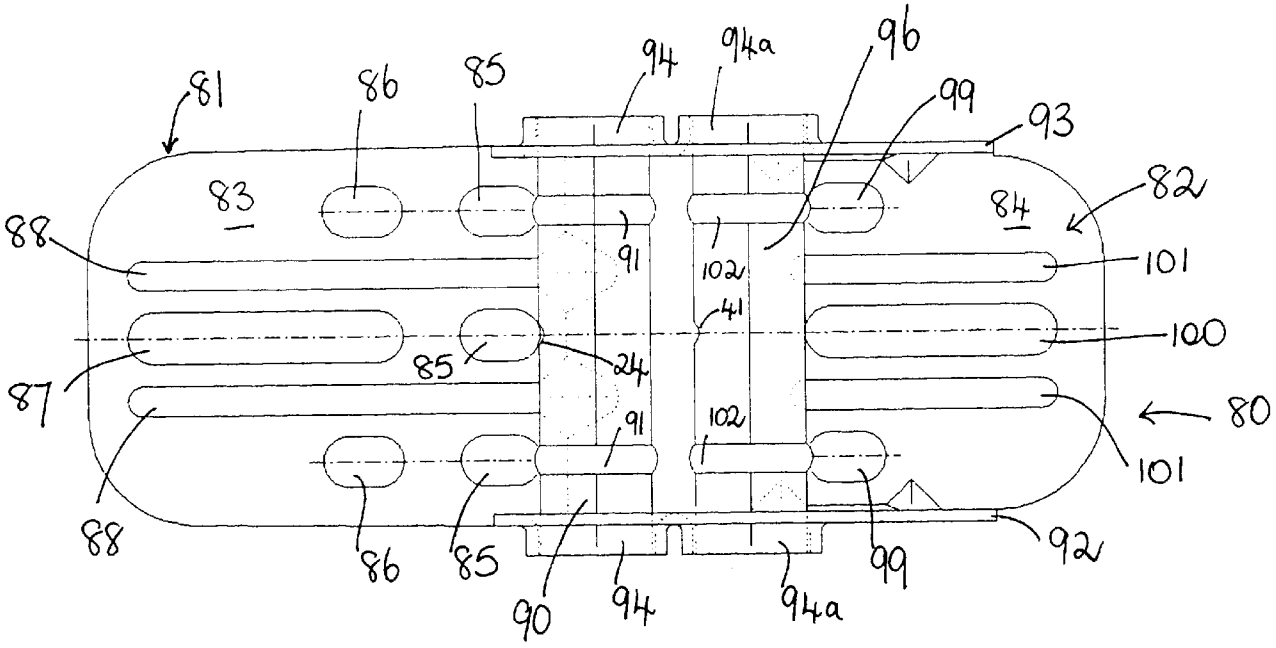
FIGS. 7*a* and 7*b* are plan and side views of an assembled typical hinge adapted to interconnect two panels other than the lowermost and next panel of the door.
Figure 7B:
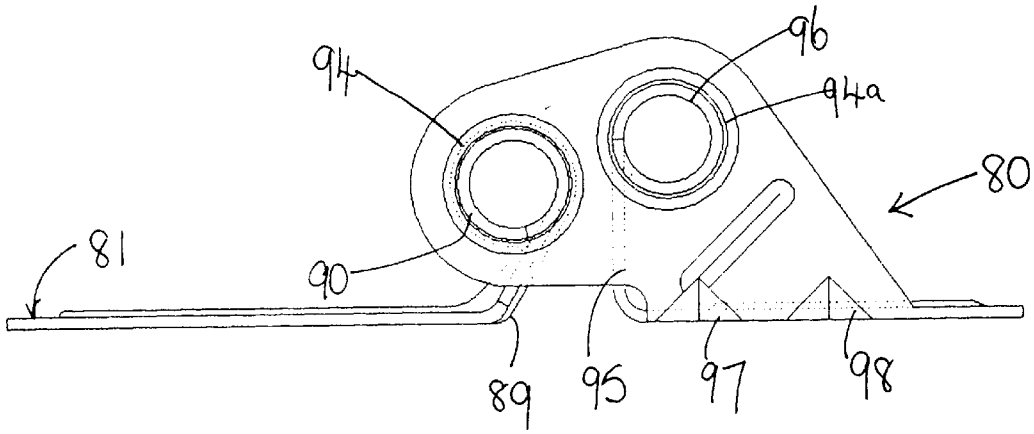

FIGS. 7*a* and 7*b* show a hinge 80 adapted to couple together panels other than the lowermost and adjacent panel of the door. The hinge has a first part 81 and a second part 82. The first part has a body 83 with a first series of mounting apertures 85 and a second series of mounting apertures 86. An elongate mounting slot 87 extends along the body 81 and between two spaced strengthening ribs 88. Outwardly extending part 89 terminates in a sleeve 90 of a length substantially the same as the distance between the outer extremities of the side flanges. The sleeve has strengthening ribs 91 extending around it.

Part 82 has a base 84 which extends between two spaced side flanges 92, 93. The flanges are provided with two pairs of apertured bosses 94, 94*a*. Bosses 94 receive sleeve 90 and allow the hinge parts to be pivotally interconnected.

An inner end 95 of the base 84 extends outwardly and is formed into a sleeve 96 having a length substantially the same as the distance between the outer extremities of the side flanges. Sleeve 96 is received by and between apertured bosses 94*a*. The guide roll pin or shaft (not shown) is rotatably received within sleeve 96. The longitudinal axis through sleeve 96 is more distant from the plane of base 84 than the corresponding axis of sleeve 90. This distance is varied to provide the desired spacing of the guide shaft from base 84. Thus, the part of the hinge interconnecting the uppermost and adjacent panel would have larger side flanges and the axis of the sleeve corresponding to sleeve 96 would be further spaced from the base between the flanges than that shown in FIG. 5*b*. The inner and corresponding end 95 would of course be commensurately longer. Flanges 92, 93 have strengthening deformations 97, 98 while base 84 has apertures 99, slot 100 and ribs 101. The sleeve 96 has strengthening ribs 102 extending around it to provide a well for lubricant introduced into the sleeve to assist rotation of the guide roller shaft within it.

Thus by forming the hinge parts in this way with integral sleeves the number of components necessary to fabricate a hinge is less than the prior art previously discussed. As a consequence, construction and assembly of the hinge of the invention is simplified.

I claim:

1. A hinge for interconnecting two adjacent panels of a sectional overhead door, the hinge including a first hinge part and a second hinge part, the first hinge part having a body with an integrally formed sleeve extending across the body, the second hinge part being substantially U shaped and having two opposed side flanges and an interconnecting base extending between the flanges, a first pair of opposed apertures in the flanges adapted to receive the sleeve whereby the two hinge parts may pivot relative to one another, the second hinge part having a second pair of opposed apertures formed in the side flanges, said interconnecting base having an extension with an end thereof formed into a second sleeve, said second sleeve having a length substantially the same as the distance between outer extremities of the flanges and said second sleeve being received by the second pair of opposed apertures.

2. The hinge of claim 1 wherein the hinge parts include mounting apertures.

3. The hinge of claim 2 wherein the mounting apertures in the first hinge part include a first series of three apertures transversely spaced across the body.

4. The hinge of claim 3 wherein the first hinge part includes a second series of two mounting apertures spaced transversely on the body and from the first series of apertures.

5. The hinge of claim 3 including a mounting slot extending along the body of the first hinge part.

6. The hinge of claim 2 wherein the mounting apertures in the second hinge part include a first series of two transversely spaced apertures in the connecting base.

7. The hinge of claim 6 wherein the second hinge part includes a mounting slot extending along the connecting base.

8. The hinge of claim 1 wherein the first hinge part includes strengthening ribs formed in the sleeve and in the body.

9. The hinge of claim 1 wherein the second hinge part has strengthening ribs formed in the base and the flanges.

10. The hinge of claim 1 wherein the second hinge part has bosses extending around each said aperture of the first pair of opposed apertures.

11. The hinge of claim 1 wherein the sleeve has a length substantially the same as the distance between the outer extremities of the flanges.

12. The hinge of claim 1 wherein the sleeve has an aperture through which a lubricant may be introduced.

13. The hinge of claim 1 wherein the second sleeve has strengthening ribs and is adapted to receive a shaft having a guide roller at one end.

14. The hinge of claim 13 including bosses extending around the second pair of opposed apertures.

15. The hinge of claim 1 wherein the second sleeve has an aperture to enable a lubricant to be introduced.

16. A method of forming the hinge of claim 1 including the steps of forming the first hinge part from a blank of material, forming the second hinge part from a blank of material with the side flanges in the same plane as the interconnecting base, placing the hinge parts adjacent one another and configuring the side flanges so they extend substantially at right angles to the base whereby ends of the sleeve on the first part are received by the apertures of the first pair of opposed apertures in the second part.

17. A method of forming the hinge of claim 1 including the steps of forming the first hinge part from a blank of material, forming the second hinge part from a blank of material with the side flanges in the same plane as the interconnecting base, forming the extension of the base so that it extends outwardly from the base and forming an end of the extension into the second sleeve, placing the parts next to each other and configuring the side flanges so that they extend substantially at right angles to the base whereby ends of the sleeve of the first hinge part and ends of the second sleeve are received by the first pair of apertures and the second pair of apertures respectively.

* * * * *